US007032271B2

(12) United States Patent
Lin

(10) Patent No.: US 7,032,271 B2
(45) Date of Patent: Apr. 25, 2006

(54) NOISE CONTROL DEVICE FOR A STEEL DOOR

(76) Inventor: Jung-Hui Lin, 3 Fl.-3, No. 128, Jianmin Rd., Lingya District, Kaohsiung City (TW)

( * ) Notice: Subject to any disclaimer, the term of this patent is extended or adjusted under 35 U.S.C. 154(b) by 0 days.

(21) Appl. No.: 10/815,741

(22) Filed: Apr. 2, 2004

(65) Prior Publication Data

US 2005/0217072 A1 Oct. 6, 2005

(51) Int. Cl.
*E05F 5/06* (2006.01)

(52) U.S. Cl. ..... 16/85; 16/82; 16/86 B

(58) Field of Classification Search ..... 16/82, 16/85, 86 R, 86 A, 86 B, 66, 69, 70; 292/DIG. 15, 292/DIG. 19, 23; 248/188.4, 410, 411; 188/281–283, 188/282.1, 282.2, 282.3; 312/238; 52/211, 52/716.7, 716.8, 718.01, 718.06, 718.03
See application file for complete search history.

(56) References Cited

U.S. PATENT DOCUMENTS

| | | | | | |
|---|---|---|---|---|---|
| 984,118 | A * | 2/1911 | Wilcox | 292/17 |
| 1,816,024 | A * | 7/1931 | Petersen | 16/85 |
| 1,923,933 | A * | 8/1933 | Kartzmark | 292/70 |
| 2,140,002 | A * | 12/1938 | Dion | 292/70 |
| 2,225,067 | A * | 12/1940 | Marin | 16/86 A |
| 2,449,686 | A * | 9/1948 | Brinda | 16/85 |
| 2,572,799 | A * | 10/1951 | Banks | 48/190 |
| 2,602,183 | A * | 7/1952 | Christiansen | 452/179 |
| 3,376,088 | A * | 4/1968 | Bol et al. | 292/353 |
| 3,675,959 | A * | 7/1972 | Hansen et al. | 292/70 |
| 3,678,536 | A * | 7/1972 | Little | 16/328 |
| 3,688,342 | A * | 9/1972 | Little | 16/328 |
| 3,908,877 | A * | 9/1975 | Kosisky | 294/143 |
| 4,084,290 | A * | 4/1978 | Lymar et al. | 16/96 R |
| 4,110,868 | A * | 9/1978 | Imazaike | 16/84 |
| 4,419,398 | A * | 12/1983 | Coffy et al. | 428/174 |
| 4,452,437 | A * | 6/1984 | Lochner | 267/64.22 |
| 4,895,401 | A * | 1/1990 | Thornton et al. | 292/254 |
| 5,482,348 | A * | 1/1996 | Mass et al. | 296/207 |
| 6,151,754 | A * | 11/2000 | Chen | 16/85 |
| 6,408,483 | B1 * | 6/2002 | Salice | 16/85 |
| 6,553,617 | B1 * | 4/2003 | Salice | 16/85 |

FOREIGN PATENT DOCUMENTS

| | | | |
|---|---|---|---|
| DE | 3922932 | A1 * | 1/1991 |
| DE | 4406944 | A1 * | 9/1995 |
| EP | 1162338 | A2 * | 12/2001 |
| EP | 1319787 | A1 * | 6/2003 |
| EP | 1348828 | A2 * | 10/2003 |
| FR | 2340438 | A * | 10/1977 |

(Continued)

*Primary Examiner*—Chuck Y. Mah
(74) *Attorney, Agent, or Firm*—Troxell Law Office, PLLC

(57) ABSTRACT

A noise control device for a steel door includes a buffer, a shock-absorbing member, a stopping member, or only includes a colliding member. The noise control device is installed at any location of a steel door and a casting where noise may be generated when the steel door is closed or opened. The buffer consists of a cylinder, a lower sponge, a coil spring, a rod, and an upper sponge and possibly a colliding member. The buffer can be mainly installed on a deadbolt groove of the casing. The shock-absorbing member may be fixed on the steel door or the casing for reducing sound. The stopping member is fixed on the steel door to face the outer end of the buffer. The noise control device can reduce noise generated in opening and closing as much as possible and preventing the both from disfiguring or denting.

6 Claims, 8 Drawing Sheets

FOREIGN PATENT DOCUMENTS

| | | | | |
|---|---|---|---|---|
| GB | 2075117 | A | * | 11/1981 |
| JP | 09041772 | A | * | 2/1997 |
| JP | 10008823 | A | * | 1/1998 |
| JP | 11182127 | A | * | 7/1999 |
| JP | 2001059377 | A | * | 3/2001 |
| WO | WO 2004095982 | A1 | * | 11/2004 |

* cited by examiner

NOISE CONTROL DEVICE FOR A STEEL DOOR

BACKGROUND OF THE INVENTION

1. Field of the Invention

This invention relates to a noise control device for a steel door, particularly to one handy to install or take off and preventing noise from occurring in opening and closing a steel door, possible to offer a peaceful environment for life, and having practical use and good function.

2. Description of the Prior Art

A conventional steel door and its casing shown in FIG. 1 includes a steel door 10*a* and a casing 11*a*, mainly having a structure emphasized for anti-theft, not so improved in the structure for noise prevention, only depending on a personal moral attitude in opening and closing action of a steel door. So a conventional steel door 10*a* and its casing 11*a* may generate some noise, and often large noise to embarrassment to people around. If worse, verbal quarrel may arise. In addition, a conventional steel door and its casing may disfigure, dent or damage owing to frequent mutual collision, causing possible unsmooth opening and closing.

So a conventional steel door 10*a* and its casing 11*a* have been found to have the following disadvantages.

1. They can easily give rise to harassing noise in opening and closing.
2. They may easily disfigure and dent.
3. The opening and closing force of the steel door is hard to control.
4. Unnecessary expense for their damage may be involved.
5. The quality of the living environment may be worsened by the noise generated by opening and closing of the steel door.
6. It is not impossible to give rise to unnecessary argue.

SUMMARY OF THE INVENTION

This invention has been devised to offer a noise control device for a steel door for reducing noise as less as possible in its opening and closing, and also disfigurement and its cost.

One of the features of the invention is a buffer of a post shape fixed on a casing. The buffer has a hollow cylinder, a fitting member fixed on an outer surface of the cylinder, a lower sponge contained in the cylinder and having elasticity to recover its original shape after compressed, a coil spring on the lower sponge to elastically push the lower sponge, a rod movably fitted in the coil spring and having its outer end attached with a colliding member and a pair of opposite projections on its outer surface to contact the outer end of the coil spring so the coil sprig may push the rod outward after the rod is pushed inward. Further, an annular upper sponge is provided around the rod at the outer side of the pair of opposite projections and an annular cap fixed firmly around the outer end of the cylinder for maintaining the upper sponge, the coil spring and the rod in the cylinder.

Another feature of the invention is a stopping member shaped as a plate, fixed on a steel door and facing the buffer on the casing, consisting of two stopping layers and an intermediate soft layer wrapped around by the two stopping layers, with an annular groove formed in the upper stopping layer and the intermediate layer to face the outer end of the rod of the buffer.

Another feature of the invention is a shock-absorbing member of a plate shape fixed on the casing, consisting of two sound-absorbing layers and a tough layer sandwiched between the two sound-absorbing layers for reducing sound and noise in cooperation with the buffer.

One more feature of the invention is a projection member of soft material fixed on an outer side of a deadbolt groove in the casing, facing the deadbolt of a lock fixed on a steel door, in order to soften and reduce noise caused by the steel door against the casing in closing.

BRIEF DESCRIPTION OF DRAWINGS

This invention will be better understood by referring to the accompanying drawings, wherein:

FIG. 9 is a cross-sectional view of a second embodiment of a noise control device for a steel door in the present invention; and, FIG. 10 is a cross-sectional view of a projecting member in the present invention.

DETAILED DESCRIPTION OF THE PREFERRED

Embodiments

Figure 1:
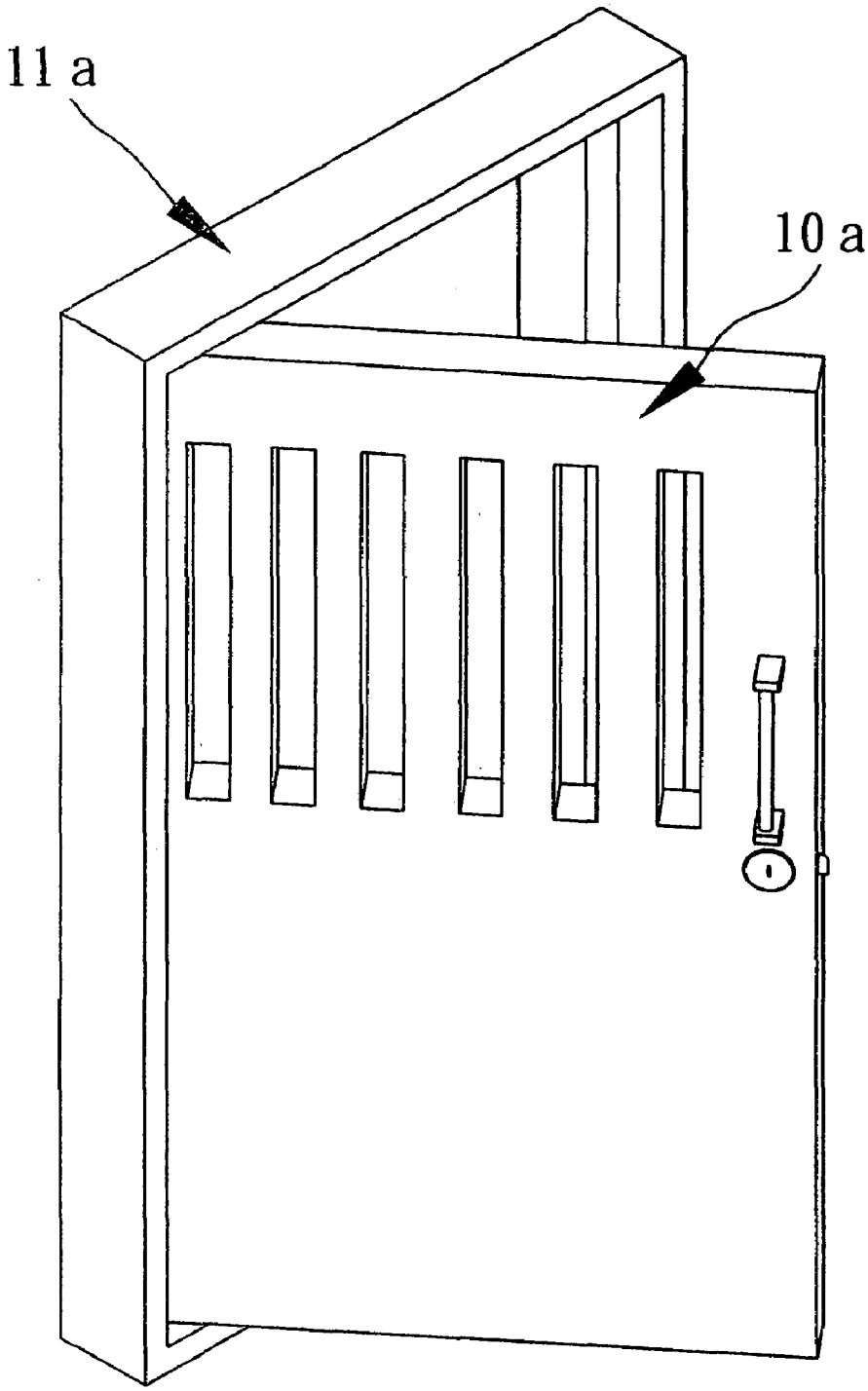
Fig. 1(prior art)
FIG. 1 is a perspective view of a conventional steel door and it's casing.
Figure 2:
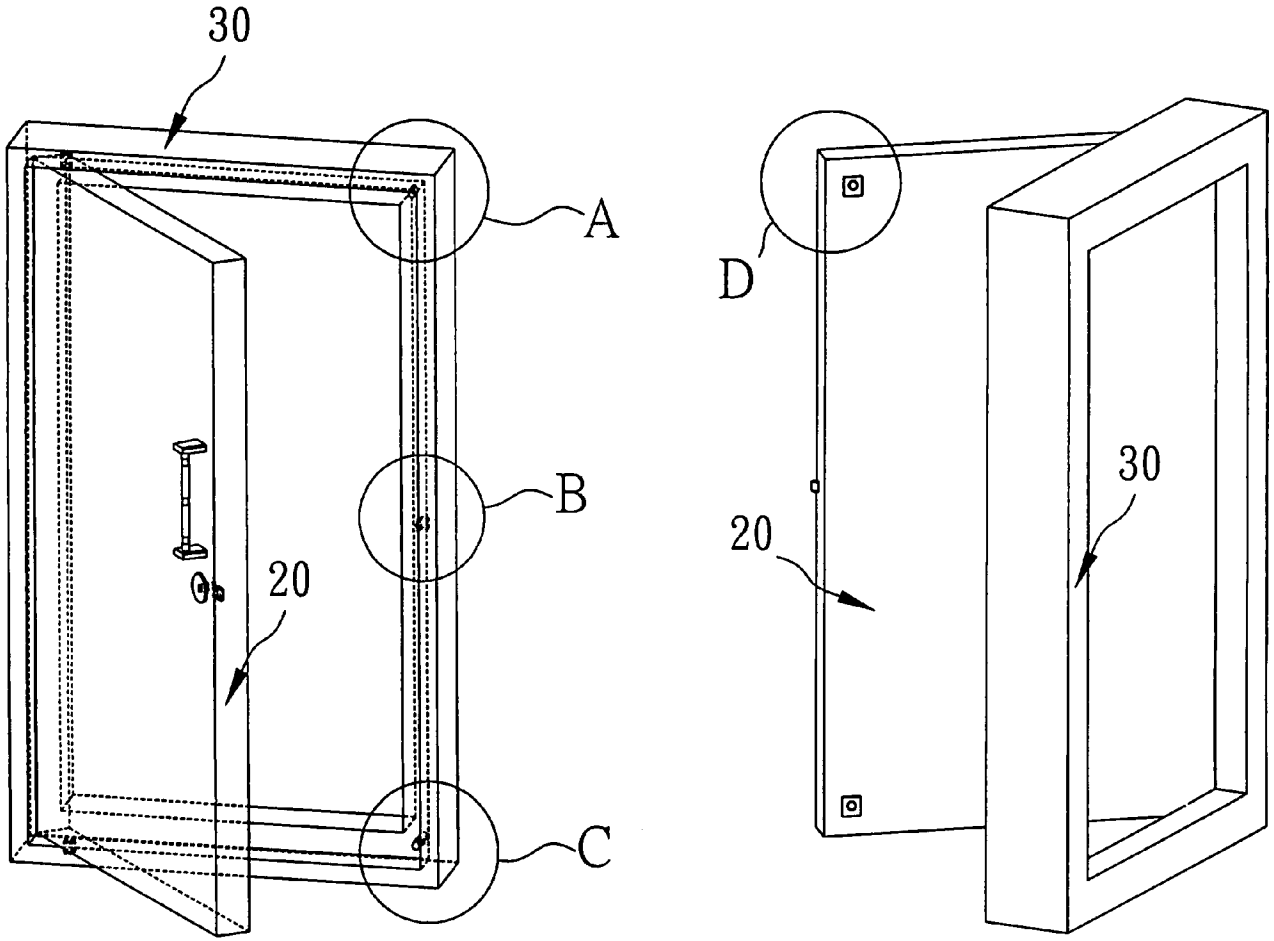
FIG. 2 is a perspective view of the locations where a noise control device for a steel door is installed in the present invention.

A first embodiment of a noise control device 1 for a steel door in the present invention, as shown in FIGS. 2, 3, 4 and 8, is installed respectively in a steel door 20 and a casing 30 at the locations marked A, B, C and D, including a buffer 10, a shock-absorbing member 11, a stopping member 12 as main components.

The buffer 10 is shaped as a post, and installed in a deadbolt groove 301 of the casing 30, consisting of a cylinder 100, a fitting member 1000 fixed on an outer surface of the cylinder 100 to fit in the wall defining the deadbolt groove 301 so as to secure the buffer 10 stably in the casting 30. The cylinder 100 contains a round lower sponge 101 with some elasticity, a coil spring 102 on the lower sponge 101, a rod 103 movably located in the coil spring 102 and having a pair of studs 1030 on its outer surface contacting the upper end of the coil spring 102 so that the coil spring 102 may push the rod 103 outward after the rod 103 is moved inward. Further, an annular upper sponge 104 with some elasticity is provided around the rod 103 beside the stud 103 to let the rod 103 shift back and forth smoothly. Then an annular cap 105 fits tightly around the outer end of the cylinder 100 indirectly on the upper sponge 104, with a center hole 1050 for the rod 103 to pass through, sealing the other components (the lower sponge 101, the coil spring 102, the rod 103, and the upper sponge 104). Then a colliding member 106 of preferably a cone shape can be attached stably around the outer end of the rod 103.

Thus the buffer 10 can prevent the steel door 20 and the casing 30 from generating noise or disfiguring by reducing big moving force of the steel door 20 colliding the casting 30 in opening and closing, especially in closing.

Next, FIG. 9 shows a second embodiment of the invention, having almost the same structure of the first one, except that the buffer 10 is not provided with the colliding member 106, fixed invisible in the casing 30 or the steel door 20. In case that the buffer 10 without the colliding member 106 is not to be used, the cylinder 100 is rotated for a certain angle, letting the fitting member 1000 fit into a small recess in the deadbolt groove 301 of the casing 30. Then the buffer 10 becomes invisible.

Next, FIGS. 5, 6, 7, 8 and 10 show an absorbing member 11 fixed on the casing 30, including a shock-absorbing layer 110 and a tough layer 111 wrapped around by the shock-absorbing layer 110. Then the shock-absorbing member 11 can reduce noise as much as possible in conjunction with the buffer 10 in opening and closing of the steel door 20.

The stopping member 12 is fixed on the steel door 20, at the locations corresponding to the buffers 10 fixed on the casing 30, consisting of two stopping layers 120, an intermediate soft layer 121 sandwiched between the two stopping layers 120, an annular groove 122 formed in an upper stopping layer 120 and the intermediate soft layer 121 to face the rod 103 of the buffer 10 to let the outer circumference of the stopping member 12 not projecting up in case of the colliding member 106 of a cone shape colliding the stopping member 12 in closing the steel door 20, so the colliding force may be converged to the pointed end of the colliding member 106. As the annular groove 122 can offset the colliding force radially, the stopping member 12 does not fall off the steel door 20, attaining the function of buffering colliding force, and shock and sound absorbing.

Figure 3:
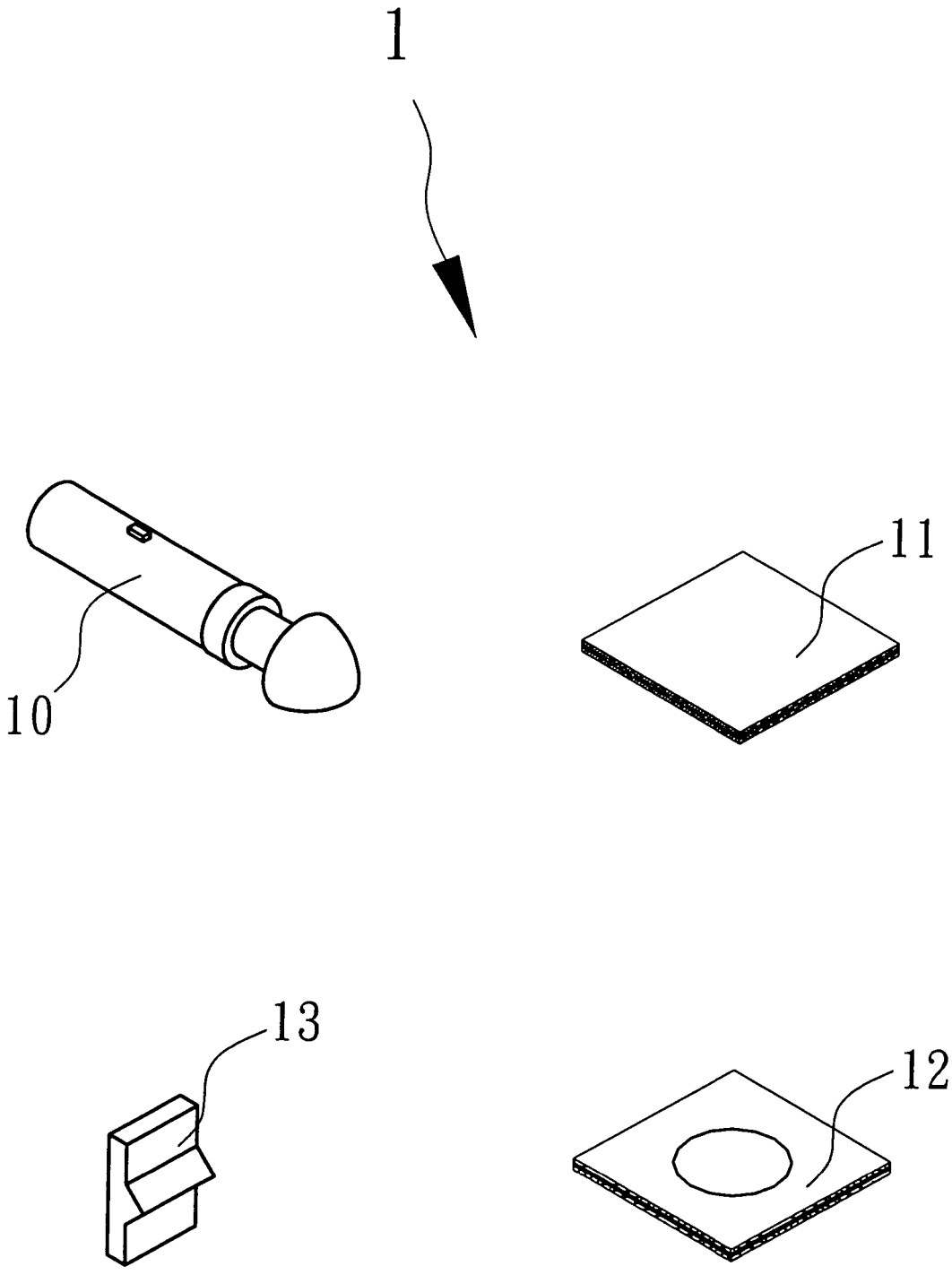
FIG. 3 is an exploded perspective view of a noise control device for a steel door in the present invention.
Figure 4:
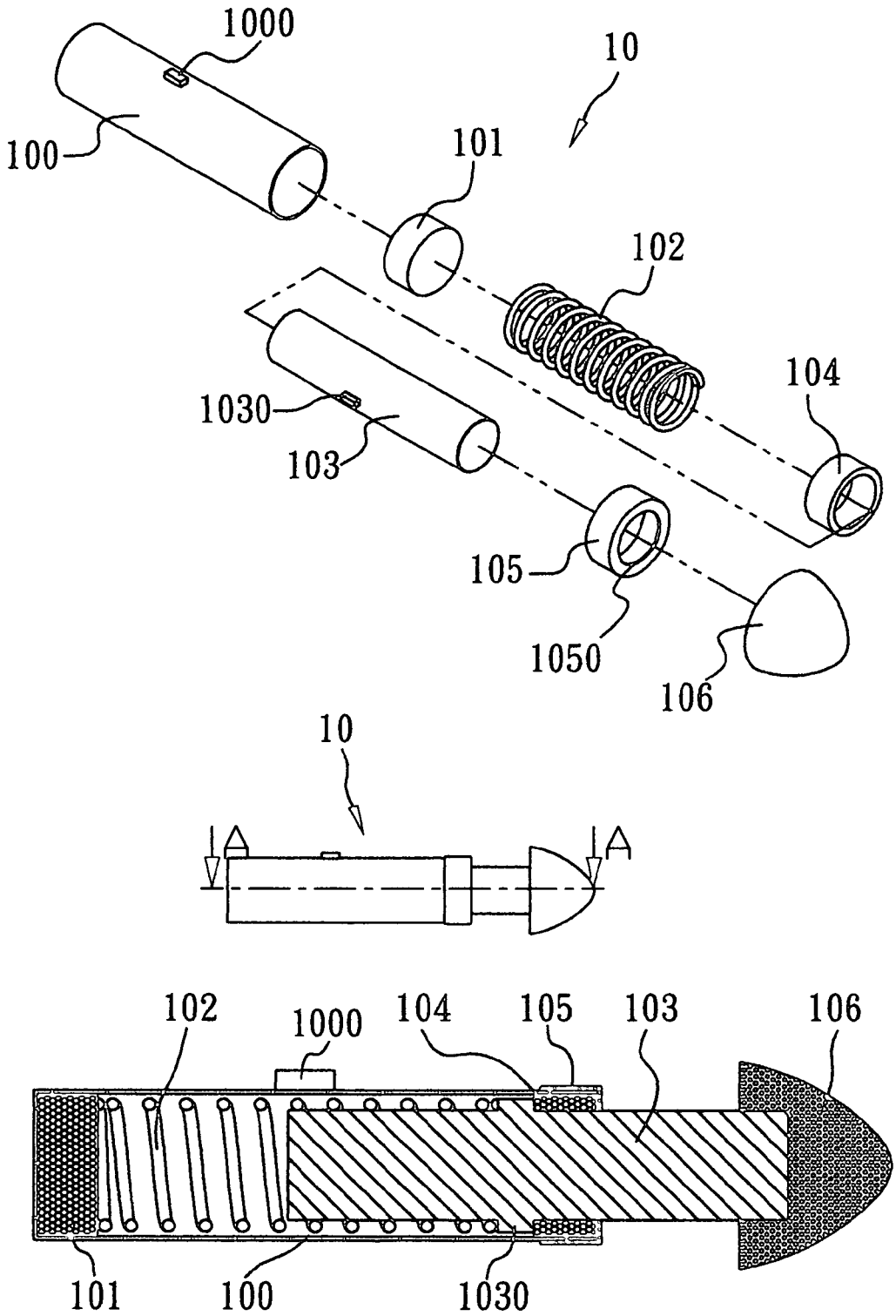
FIG. 4 is an exploded perspective view of a buffer in the noise control device for a steel door in the present invention.
Figure 5:
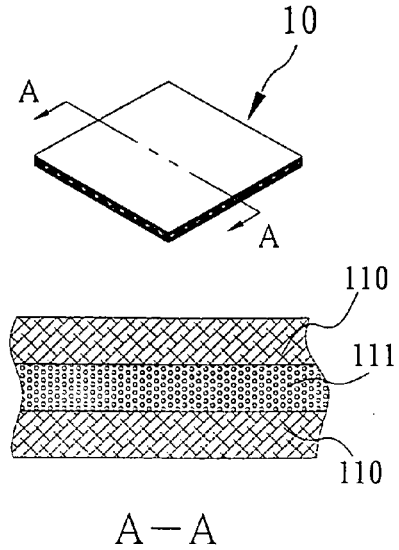
FIG. 5 is a cross-sectional view of a shock-absorbing member in the noise control device for a steel door in the present invention.
Figure 6:
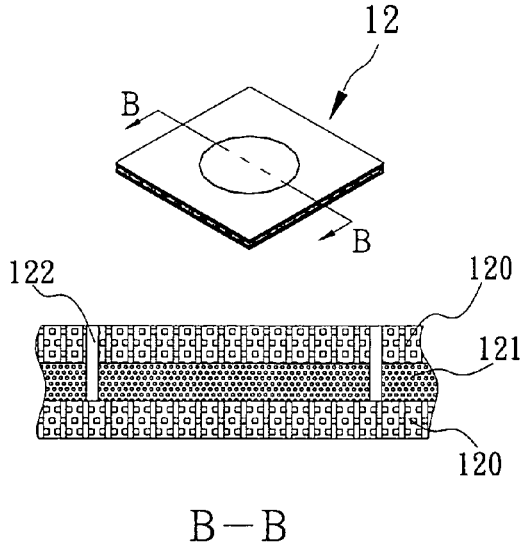
FIG. 6 is a cross-sectional view of a colliding member in the noise control device for a steel door in the present invention.
Figure 7:
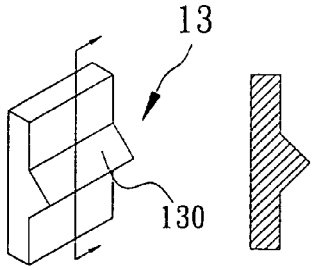
FIG. 7 is a perspective and a cross-sectional view of a projection member in the present invention.
Figure 8:
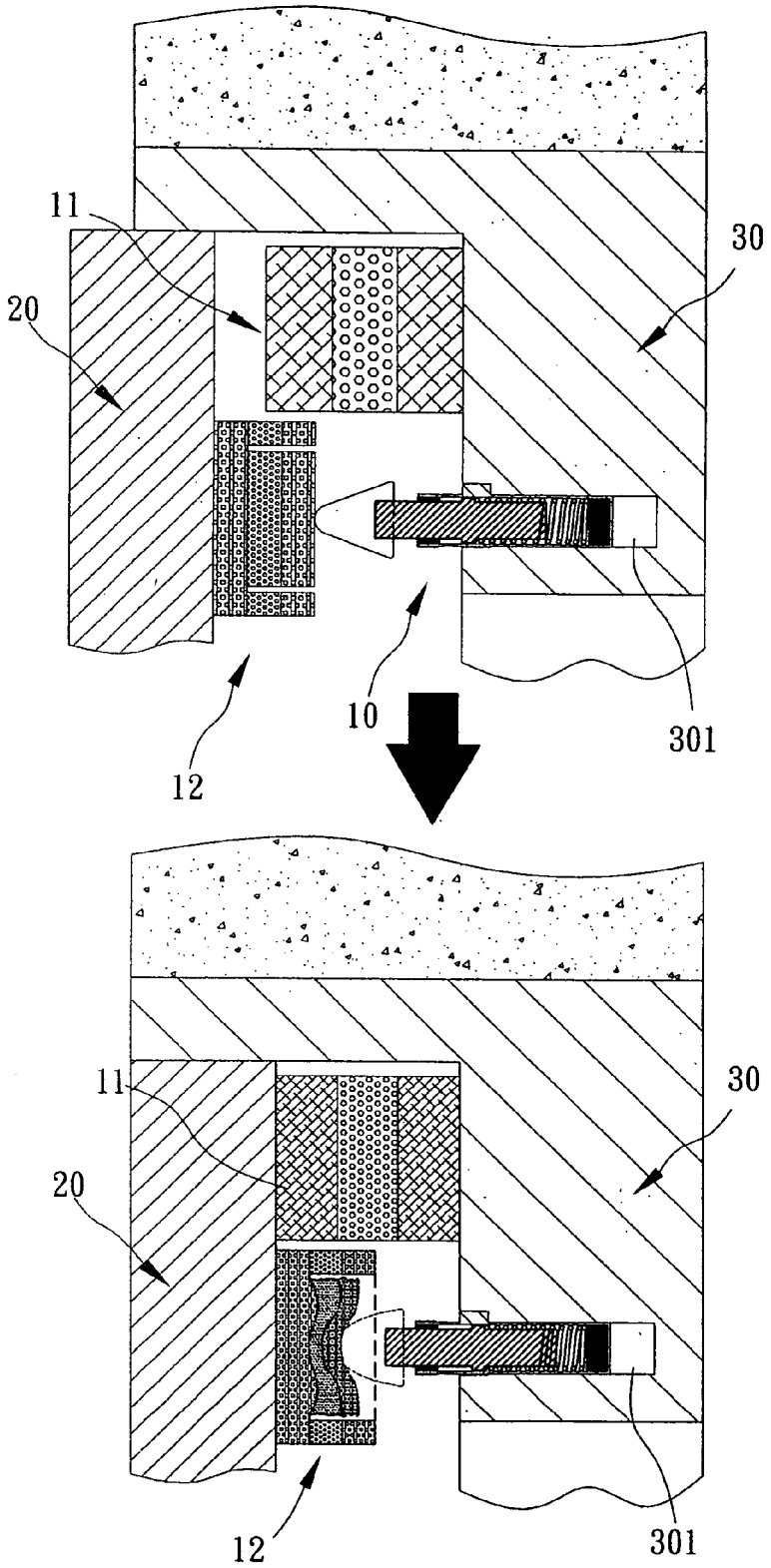
FIG. 8 is a cross-sectional view of a first embodiment of a noise control device for a steel door in the present invention.
Figure 6:
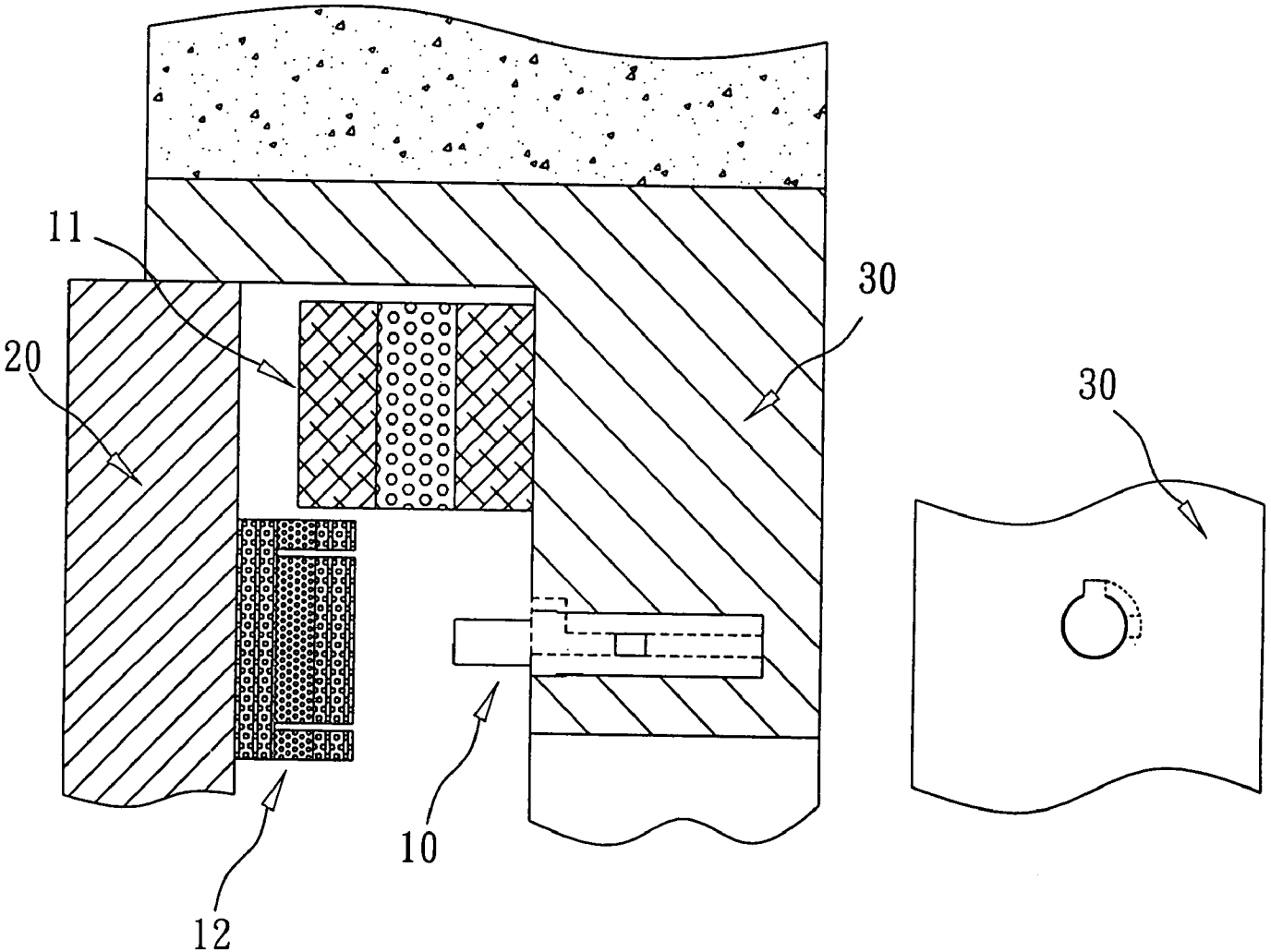
Figure 10:
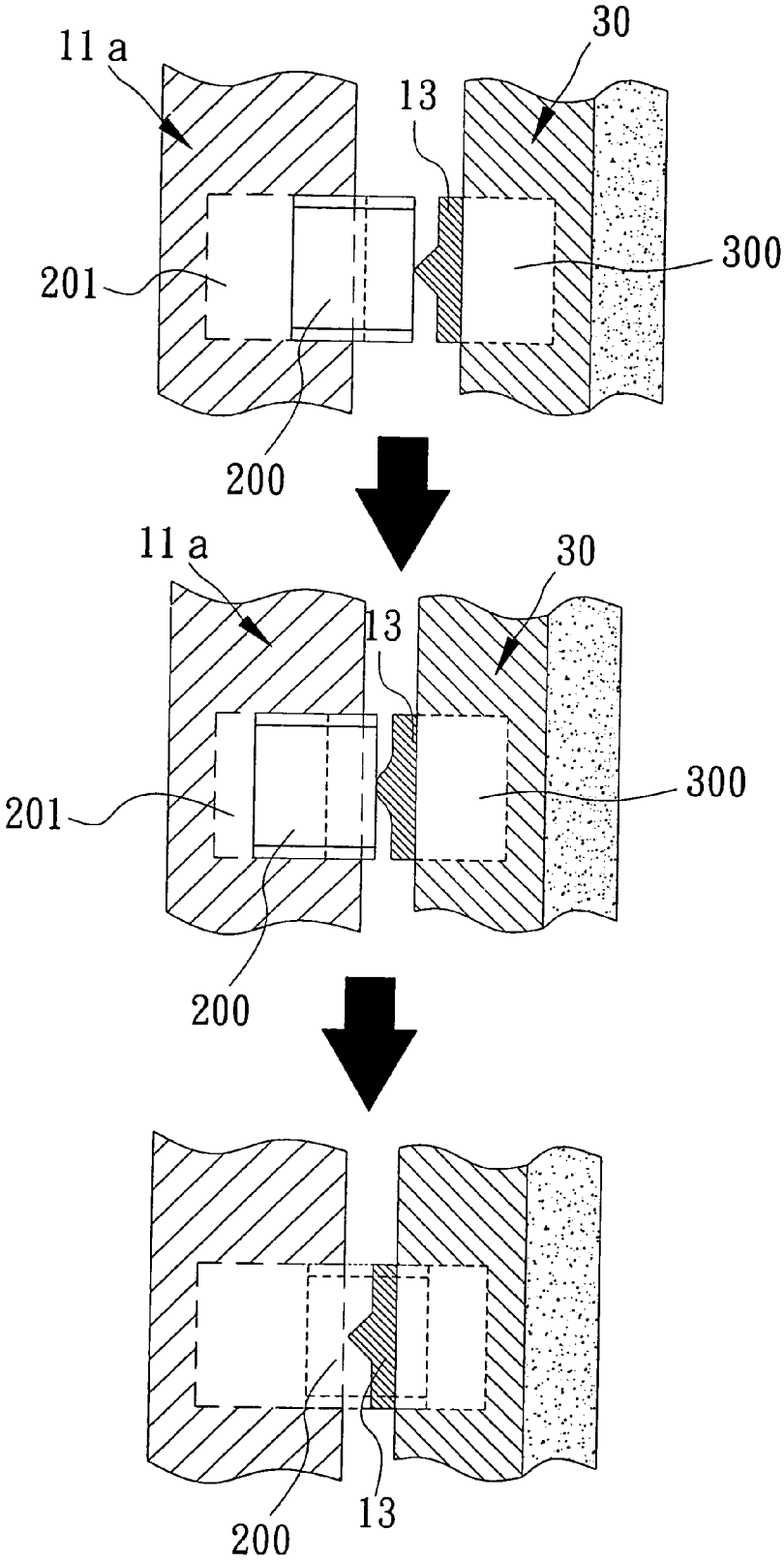

Next, FIG. 10 shows a projecting member 13 made of a soft material and fixed on an outer side of the deadbolt groove 300 of the casing 30 as shown in FIGS. 3 and 10, having a vertical board portion and a projection portion 130 extending sidewise from an intermediate section of the surface of the vertical board portion to correspond to a deadbolt 200 of a lock on the steel door 20. When the steel door 20 is closed up, the deadbolt 200 collides the projection portion 130, and is pushed back a little in the deadbolt groove 201, with the projecting portion 130 shrunk. But the deadbolt 200 can move forward again into the deadbolt groove 300 of the casing 30 and stops therein to prevent the steel door from opened, as the steel door 20 continues to shift forward to close. Then the projecting portion 130 recovers its original shape. Thus the projection member 13 can prevent the deadbolt from generating noise caused by colliding the casting 30.

The present invention has the following advantages, as can be understood from the foresaid description.

1. It has a simple structure, easily installed.
2. It can be hidden invisible when not used.
3. It hardly generates noise to harass people around in opening and closing.
4. A steel door and a casing may not disfigure or dent.
5. It can control the force of opening and closing of a steel door.
6. It can upgrade the quality of the environment for life.

While the preferred embodiments of the invention have been described above, it will be recognized and understood that various modifications may be made therein and the appended claims are intended to cover all such modifications that may fall within the spirit and scope of the invention.

What is claimed is:

1. A noise control device for a steel door installed in a casing, said noise control device comprising:

a buffer fixed on the casing, shaped post-like, consisting of a hollow cylinder, a fitting member fixed on an outer surface of said cylinder, a round lower sponge of some elasticity contained in said cylinder, a coil spring of good elasticity positioned on said lower sponge in said cylinder, a rod located in said coil spring having a pair of opposite studs on its outer surface and contacting an upper end of said coil spring, a colliding member fixed around an outer end of said rod, an annular upper sponge of some elasticity located to contact an upper end of said studs and having a center hole for said rod to pass through, an annular cap fitting firmly around an outer end of said cylinder and having a center hole for said rod to pass through and positioning said lower sponge, and said coil spring in said cylinder:

a stopping member fixed on the steel door and facing said buffer fixed on the casing, having two stopping layers and an intermediate soft layer sandwiched between said two stopping layers, an annular groove formed a central area of an upper one of said stopping layers and the intermediate layer facing said rod of said buffer:

a shock-absorbing member fixed on the casing, consisting of two sound-absorbing layers and a tough layer, said tough layer wrapped by said two sound-absorbing layers: and a projecting member attached on an outer side of a deadbolt groove of the casing, having a vertical wall portion and a projecting portion extending sidewise and outward from an intermediate section of said wall portion to face the deadbolt of a lock fixed on the steel door.

2. The noise control device for a steel door as claimed in claim 1, wherein said buffer is fixed on a predetermined location of the casing.

3. The noise control device for a steel door as claimed in claim 2, wherein said projecting portion is a ridge-shaped projection.

4. The noise control device for a steel door as claimed in claim 1, wherein said buffer is fixed on a predetermined location of the steel door.

5. The noise control device for a steel door as claimed in claim 1, wherein said buffer is concealed in the casting.

6. The noise control device for a steel door as claimed in claim 1, wherein said buffer is concealed in the steel door.

* * * * *